US005103934A

United States Patent [19]

Brooks

[11] Patent Number: 5,103,934

[45] Date of Patent: Apr. 14, 1992

[54] METHOD AND APPARATUS FOR PROVIDING A FIRE ESCAPE FOR A MULTI-STORY BUILDING

[76] Inventor: Van L. Brooks, 12527 Promenade, Detroit, Mich. 48213

[21] Appl. No.: 597,186

[22] Filed: Oct. 15, 1990

[51] Int. Cl.[5] ..... E06C 9/10

[52] U.S. Cl. ..... 182/19; 182/77; 182/84; 182/86; 182/106; 182/207

[58] Field of Search ..... 182/84, 85, 83, 88, 182/79, 212, 19, 81, 77, 86, 106

[56] References Cited

U.S. PATENT DOCUMENTS

| | | | |
|---|---|---|---|
| 437,333 | 9/1890 | Cuff | 182/86 |
| 882,499 | 3/1908 | Hull | 182/86 |
| 1,002,146 | 8/1911 | Gore | 182/77 |
| 2,448,335 | 8/1948 | Wallace | 182/84 |
| 4,244,443 | 1/1981 | Naka | 182/84 |
| 4,792,015 | 12/1988 | Brudi | 182/19 |

*Primary Examiner*—Reinaldo P. Machado
*Attorney, Agent, or Firm*—John R. Benefiel

[57] ABSTRACT

An emergency escape system for multistory buildings in which stair units are stored in recesses in the floor of each above grade level of the building. The stair units are released for gravity depolyment to the next below balcony in an emergency, and a cover panel is opened to enable egress by building occupants through the recess, down the deployed stairs to the next balcony and so on until ground level is reached.

7 Claims, 6 Drawing Sheets

METHOD AND APPARATUS FOR PROVIDING A FIRE ESCAPE FOR A MULTI-STORY BUILDING

BACKGROUND OF THE INVENTION

This invention concerns emergency escapes from multi-story buildings, i.e., means for occupants to exit a burning building with the elevators and stairwells rendered unusable as unsafe by the fire.

Recurring disasters involving fires in high rise buildings have made clear the urgent need for providing some means for emergency egress by occupants of such buildings.

Formerly, fire escapes consisting of externally mounted stairways were provided, but modern construction has eliminated such structures, primarily for aesthetic and cost considerations.

Many schemes have been devised for emergency escape, but many have been too hazardous for general use, or have involved elaborate structures too costly as a practical matter.

SUMMARY OF THE INVENTION

The present invention provides a low cost yet safe to use apparatus for emergency egress from a multi-story building. The apparatus comprises a gravity extended stair unit stored in a recess formed in the floor of a balcony provided on the exterior of each level of the building, the stair unit containing a pair of stair sections stacked horizontally one atop the other and retained within a box like structure and covered with a lid rendering the balcony floor entirely usable. The stair sections are normally held within the recess but are selectively released to pivot down, each lower section sliding down on rollers on the associated upper section, the sections moving by gravity to a locked end to end relationship, with the lower sections resting on the floor of next below balcony.

Upon lifting of the lid an occupant can safely exit through the recess and down the extended stair sections.

Existing balconies have recesses cut into the floor portion and the stored stair units installed in the opening.

Balcony floor assemblies each containing a stored self extending stair unit may be retrofitted to buildings that do not have existing balconies.

A slide-out concealed installation of the stair units may be employed in residential buildings.

A hinged side rail may be provided on the upper stair section.

DETAILED DESCRIPTION

Figure 8:
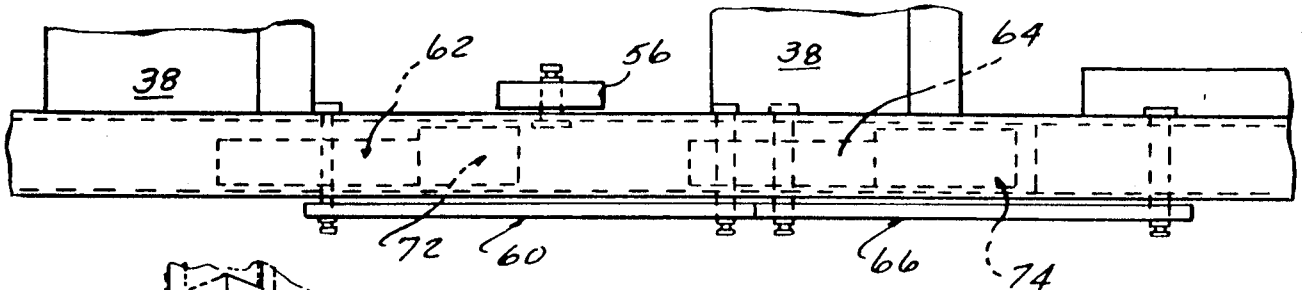
FIG. 8 is a plan fragmentary view of the rail sections shown in FIG. 7.

In the following detailed description, certain specific terminology will be employed for the sake of clarity and a particular embodiment described in accordance with the requirements of 35 USC 112, but it is to be understood that the same is not intended to be limiting as the invention is capable of taking many forms and variations within the scope of the appended claims.

According to the concept of the present invention, external balcony structures are used to mount and conceal extendible stair units stored recessed into the floor of each balcony.

The multi-story building 10 may already have external balconies 12 adjacent windows or door walls 14 at each above grade level, which may be openable either in normal use or on a one time emergency basis. The balconies 12 are aligned vertically with balconies of the next above and below floors.

In the event balconies 14 are not provided, retrofitted balcony units may be added to the structure immediately adjacent window openings.

The floor 16 of each balcony 14 is typically solidly constructed as of reinforced concrete, and is provided with a rectangular recess 18 extending across the width thereof which normally stores stair units 20 which may be released to extend down to the next below balcony 14 to allow building occupants to descend each stair unit 20 to the next below balcony.

The recess 18 may be cut into the floor 16 of the balconies 14 for applications to buildings having existing balconies, providing suitable addition to the steel reinforcing; or, if balcony stair units are added, the floors 16 are built with the recesses 18 to accommodate the stair units 20.

Figure 2:
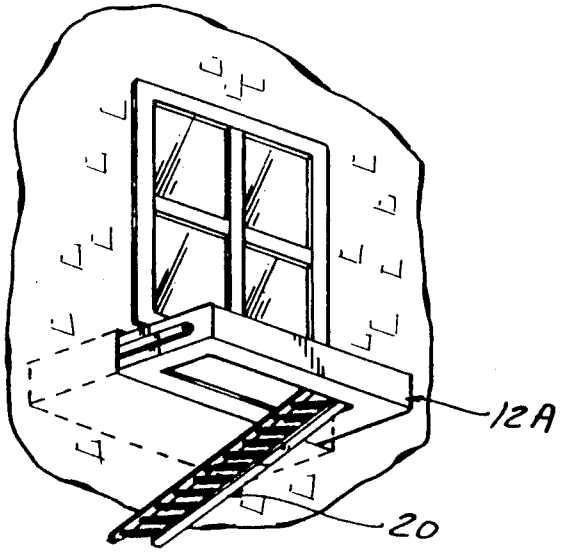
FIG. 2 is a fragmentary perspective view of a building having retracted balconies each equipped with the stored self extending stairway units according to the present invention.
Figure 1:
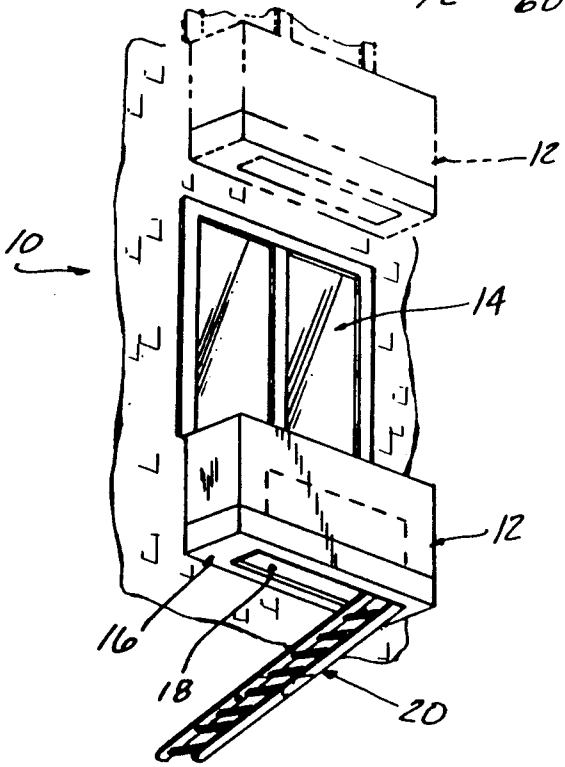
FIG. 1 is a fragmentary perspective view of a building having exterior balconies each equipped with the stored self extending stair unit according to the present invention.
Figure 3:
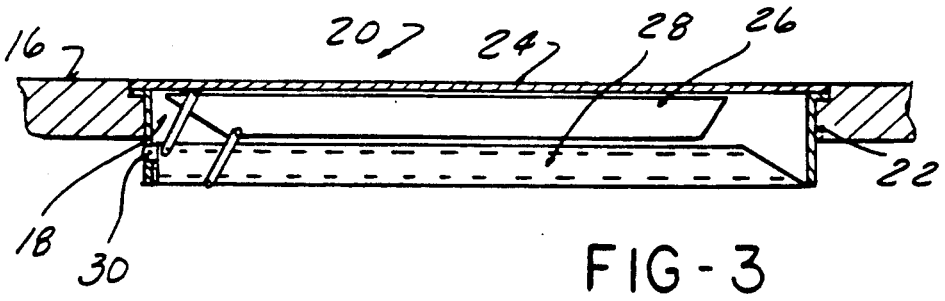
FIG. 3 is a side elevation sectional view of a stored stair unit according to the present invention, in the stored condition.

Retractable balconies 12A (FIG. 2) may also be fitted to residential and other structures in which a fixed balcony is not desired or would be objectionable. In this construction the balcony 12A would normally be stored within the structure of the building 10 and slid out in an emergency.

The extendible stair units 20 include a surrounding perimeter frame 22 set into the recess 18 of the balcony floor 16, having an upper edge located to enable a cover panel 24 to substantially lie flush with the upper surface of the balcony floor 16.

Figure 4:
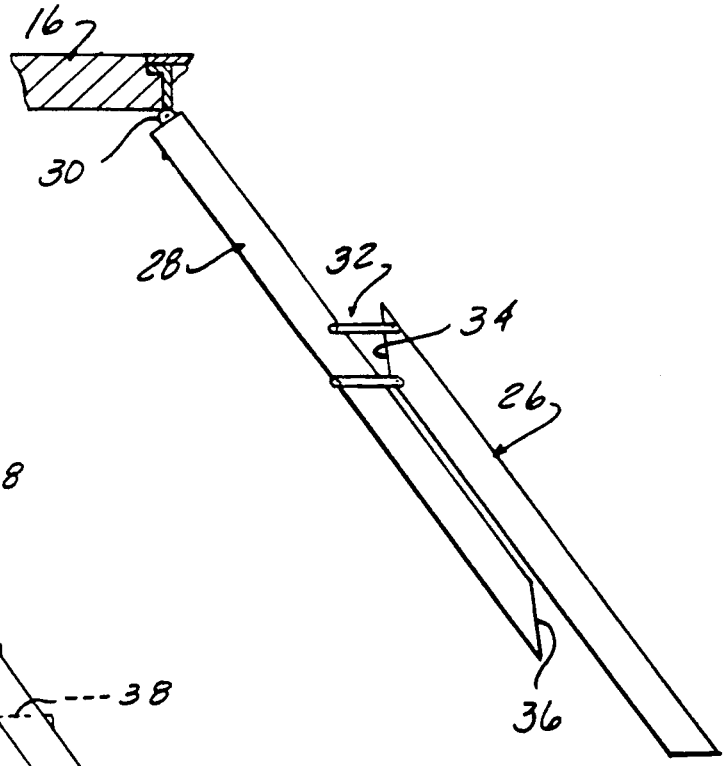
FIG. 4 is a fragmentary side elevation of the stair unit shown in FIG. 3 with the upper and lower sections released and partially extended.
Figure 5:
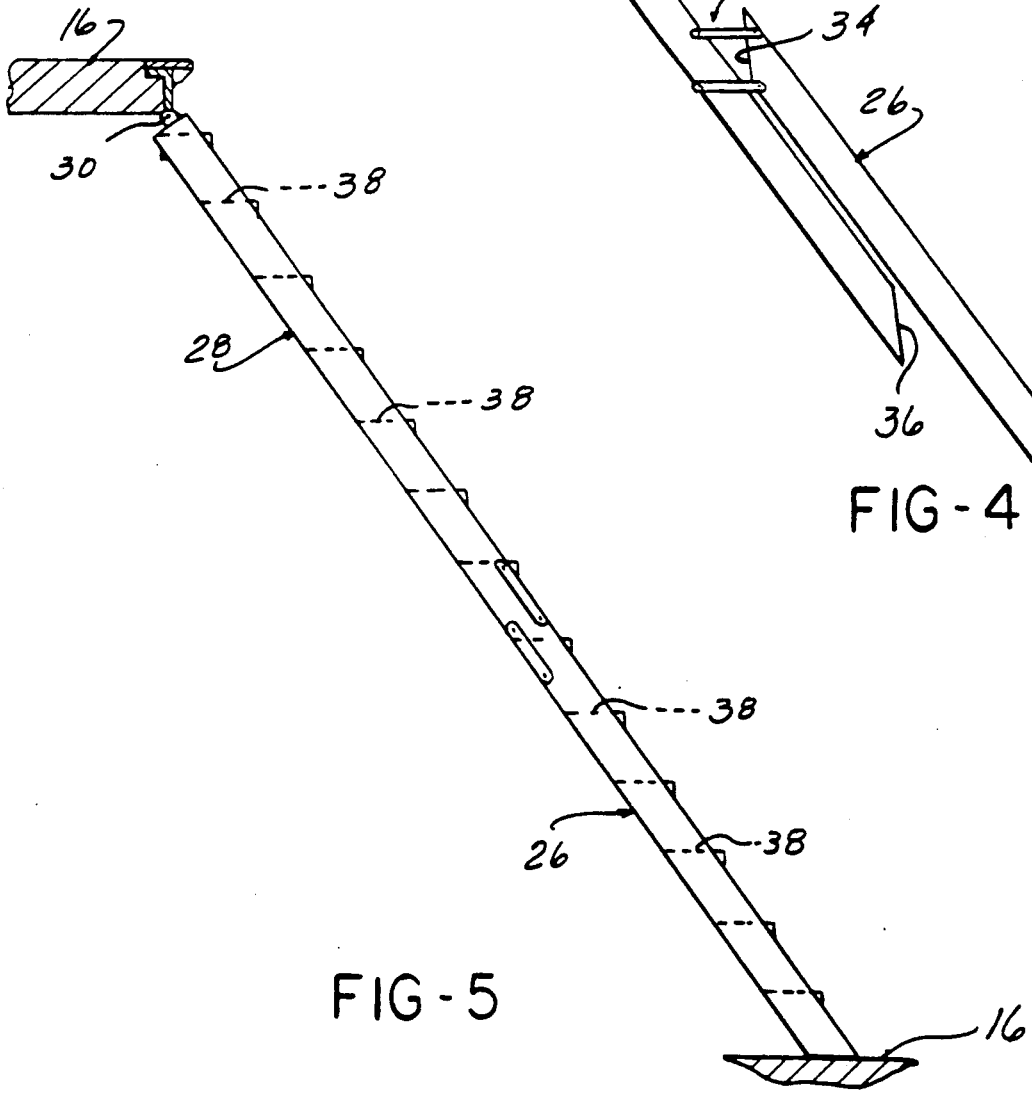
FIG. 5 is a fragmentary side elevational view of the stair unit shown in FIGS. 3 and 4, with the upper and lower sections fully extended and locked end-to-end.

An aluminum lower stair section 26 lies atop an aluminum upper stair section 28 when the stair unit is in its stored condition each stair section extending horizontally within the frame 22. The stair sections 26, 28 are held until a release mechanism is operated, allowing the upper stair section 28 to swing down about a hinge mounting 30 at its upper end; in turn, causing the lower section to ride down on a link-slider mechanism (FIG. 4) until mating ends 34, 36 of the stair sections 26, 28 move into abutment (FIG. 5). The lower end of the lower stair section 26 comes to rest on the floor 16 of the next below balcony.

Each stair section 26, 28 is provided with a series of steps 38 welded to respective pairs of side rails 44 and 50, allowing a person to safely descend from one balcony to the next, and so on until the persons descending the stairs have reached ground level.

Figure 6:
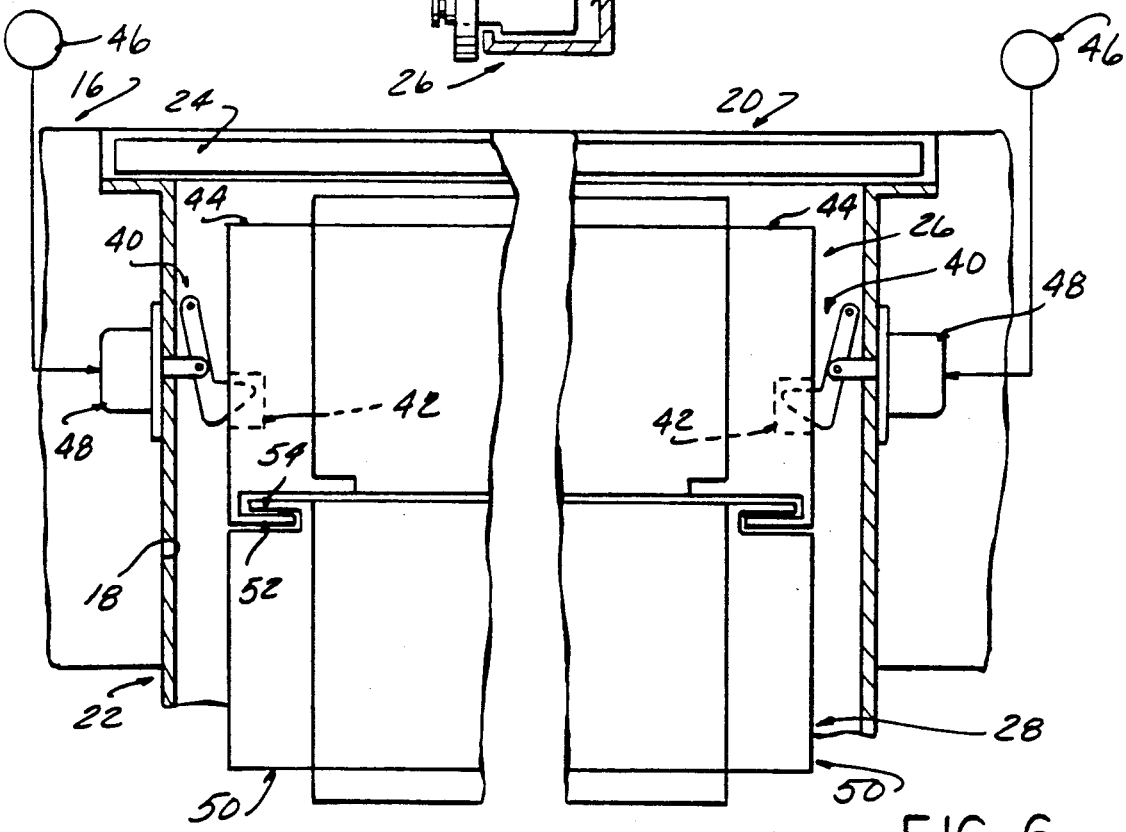
FIG. 6 is a transverse sectional view of the stored stair unit shown in FIG. 3.
Figure 9:
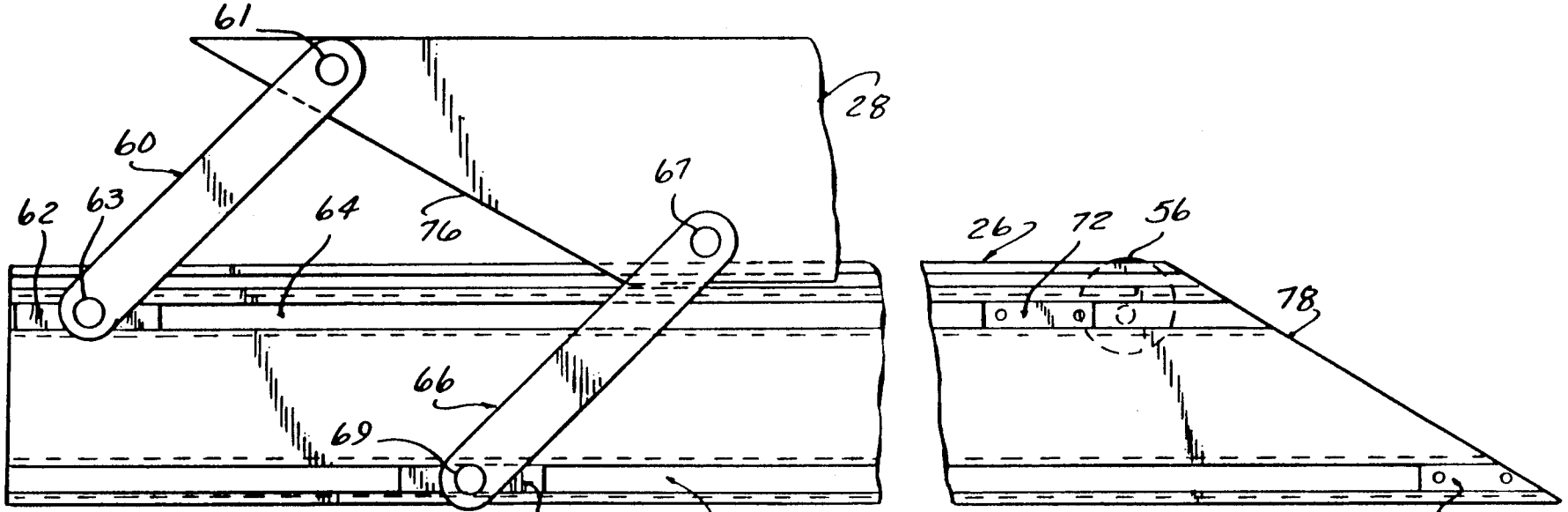
FIG. 9 is an enlarged side elevational fragmentary view of the mating end portions of the upper and lower stair sections as the upper section approaches the fully extended position.

FIG. 6 shows a solenoid operated releasing latches 40 which may be received in pockets 42 in either side rail 44 of the lower stair section 26 to hold both stair sections 26, 28 horizontally within the frame 22 until an emergency condition exists.

A central control circuit 46 either triggered automatically or manually will allow activation of solenoids 48 at each stair unit 20, releasing the same to drop out of their respective recesses 18 in each balcony floor 16.

Figure 7:
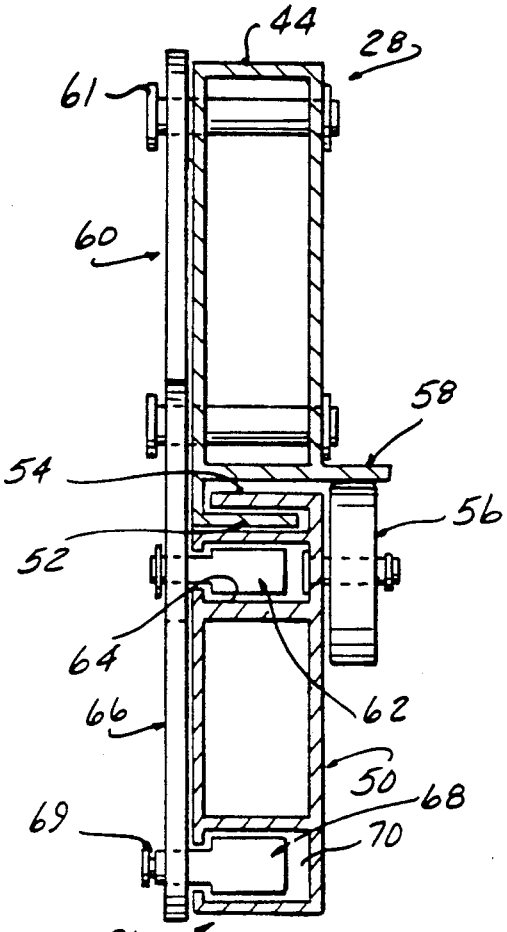
FIG. 7 is a sectional view taken across side rails of the upper and lower portions.

FIG. 7 shows some of the details of the slide linkage and roller mechanism interconnecting the upper and lower stair sections. Each side rail 44 of the lower stair section is interlocked with a corresponding side rail 50 of the upper stair section 26 by means of interleaved flanges 52, 54.

A roller 56 is mounted on each upper stair section side rail to project inwardly and beneath a support flange 58 integral with the side rail 44 of each lower stair section 28. Thus, the lower stair section 28 can slide over the upper stair section 26 with only minimal friction.

A slider linkage system includes first link 60 pinned at one end 61 to a respective side rail 44 of the lower stair section 28 and at the other end 63 to a respective slider element 62 guided within a slot 64 defined within the top of each rail 50 of the upper stair section 26.

A second parallel link 66 is also pinned at one end 67 to a side rail 44 of the lower stair section 28, and at the other end 69 to a slider element 68 guided within a slot 70 defined within the bottom of the side rail 50 of the upper stair section 26.

Figure 10:
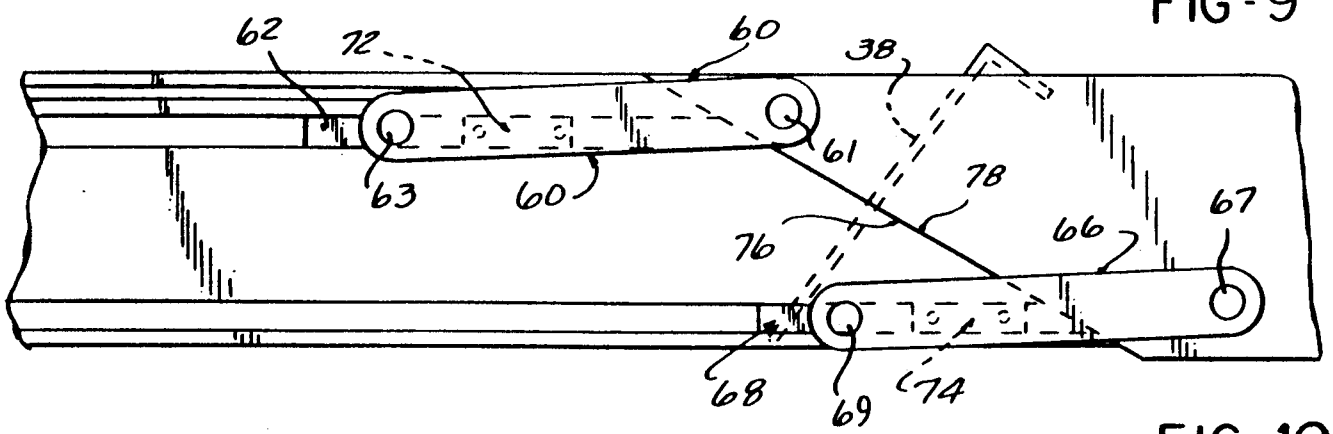
FIG. 10 shows the end portions of FIG. 9 in the fully mated and locked condition.
Figure 15:
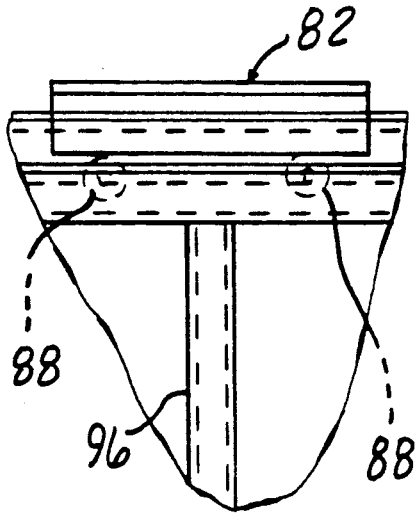
FIG. 15 is a fragmentary plan view of the portion of the stair unit shown in FIG. 13.
Figure 16:
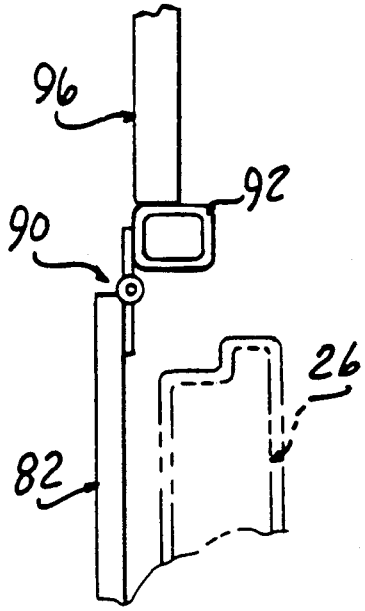
FIG. 16 is a fragmentary sectional view of the stair unit shown in FIG. 11, with the rail hinged up.
Figure 11:
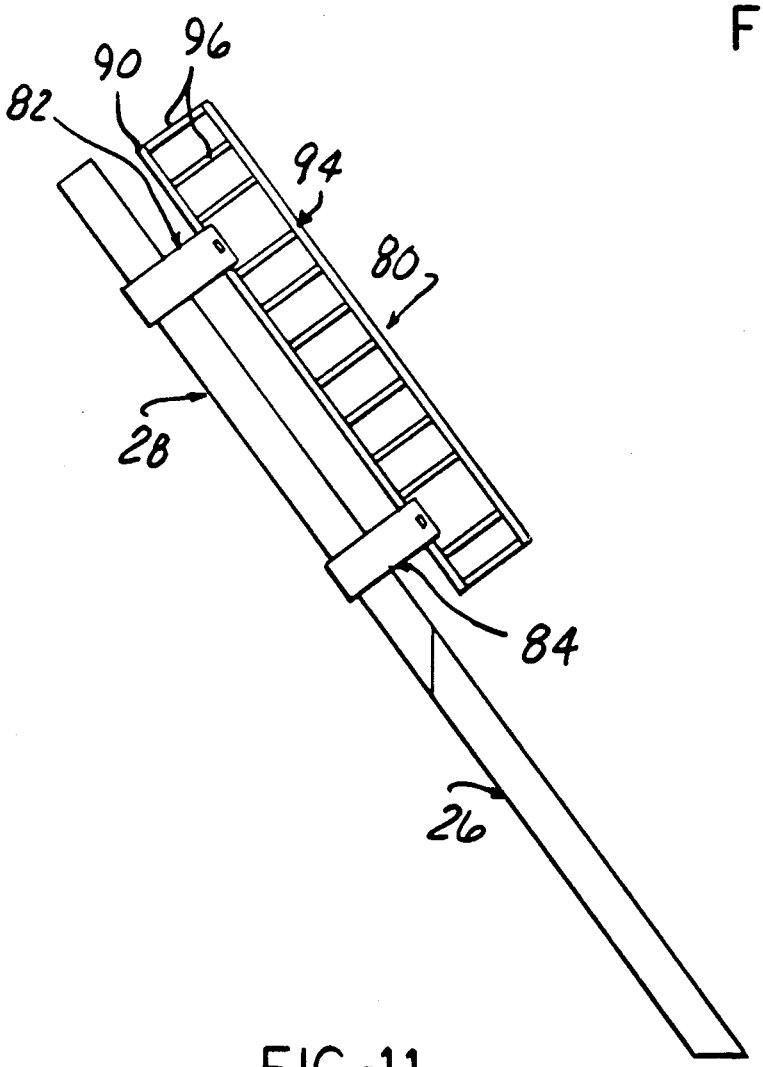
FIG. 11 is a diagrammatic side view deployed stair sections with a hinged side rail on the upper section.
Figures 12, 13, 14:
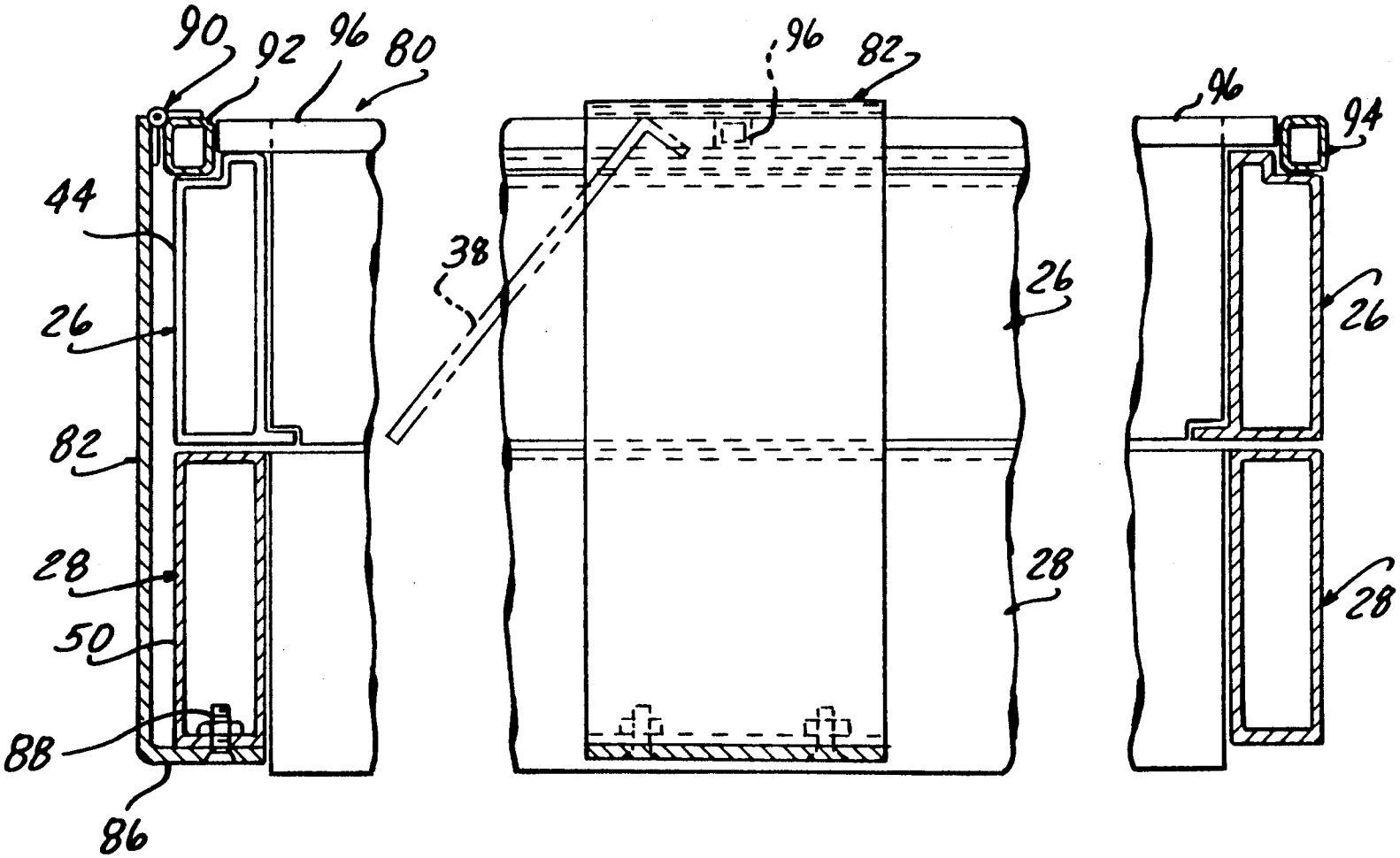
FIG. 12 is a fragmentary sectional view through one side of the stair unit of FIG. 11 in the stored condition.
FIG. 13 is a fragmentary side view of the stored stair unit shown in FIG. 12.
FIG. 14 is a fragmentary sectional view through the other side of the stair unit from that shown in FIG. 12.

Fixed steps 72, 74 are located at the end of slot 64 and 70 respectively such that as the slider elements 62, 68 reach the end of their travel, the lower stair section 28 moves into alignment with the upper stair section 26, angled end faces 76, 78 abutting each other as shown in FIG. 10, with the links 66 swung over.

Thus upon release of the latching levers 40, the stair sections drop down and extend by gravity to the next below balcony. Upon lifting the cover 24 open, occupants can exit through the opening 18 and safely descend on the extending stair sections 26, 28 to the next lower level, and so on, to escape the building.

Referring to FIGS. 11-16, another embodiment is described which incorporates a hinged side railing 80 on the upper stair section 28, which may be raised when the stair unit is deployed.

A pair of extension brackets 82, 84 are attached to side rail 50 of the upper section 28, a lower lip 86 secured tightly against the bottom face of the rail 50 by screw sets 88. The extension brackets 82, 84 extend up past the lower section 26 with the stair unit 20 in the stored condition, and mounts a series of hinges 90 welded to a bottom rail 92 of the side railing 80. The side rail 44 is formed with a relief accommodating the bottom rail 92 with the side railing 80 folded down atop the lower stair section 26.

The side railing 80 also includes a top rail 94 welded to a series of spindles 96 which are also welded to the bottom rail 92. The side railing 80 thus is stored lying atop the bottom stair section 26, but may be raised up and latched extending down the upper stair section 28.

I claim:

1. An escape system for a multi-story building comprising:

an external balcony at each above grade level of said building, each balcony including a balcony floor;

a generally rectangular recess in each of said balcony floors;

an extendable stair unit mounted within each of said recesses; each stair unit including a perimeter frame fit within said recess and a plurality of set of stair sections stored in a stack one atop the other and lying horizontally within said frame;

latch means for releasably holding each of said stair unit sections in its respective frame;

a removable cover panel including in each stair unit overlying said recess and substantially flush with the surface of said associated balcony floor;

means interconnecting and mounting said stair sections so as to allow the top most section in said stack to move downwardly and to an end to end relationship with the next below stair section in said stack upon release of said latch means, the next below stair section in said stack connected to said frame to become the upper stair section while the topmost stair section in said stack becomes the lower stair section in an extended set of stair sections;

said means interconnecting said stair sections including parallel links, each pivotally mounted at one end to the upper end of the lower stair section, said links being pivotally mounted at their other end to a respective one of a pair of slider elements, a lengthwise slot in each of the upper and lower side of said upper stair section receiving a respective slider element, said lower section able to move lengthwise to the end of said upper stair section during deployment by sliding of said slider elements, a fixed stop in each slot, each of said stair sections formed with angled end faces moving into abutment after said slider elements reach said fixed stops and cause swinging of said parallel links;

control means for selectively releasing all of said latch means upon determination that an emergency situation exists.

2. The escape system according to claim 1 wherein there are an upper and lower stair sections in each stair unit substantially fitting within the depth of its associated balcony floor.

3. The escape system according to claim 2 wherein the upper stair section is positioned beneath the lower stair section in the stored condition, said upper stair section pivotally connected at one end to said frame.

4. The escape system according to claim 1 wherein a central control circuit comprising said means for causing selective release of all of said latching means.

5. The escape system according to claim 1 further including roller means supporting said lower stair section atop said upper stair section during said lengthwise movement on said upper stair section.

6. The escape system according to claim 4 further including a side railing lying folded over said topmost stair section in said stack, said next below stair section having a plurality of extensions fixed thereto extending above the topmost stair section in said stack, and means hinging said side railing to said extensions, whereby said side rail can be hinged up from said next below stair section.

7. An escape system for a multi-story building having exterior vertical walls and window openings comprising:

a retractable floor at each grade level of said building below each window, each floor recessed within an exterior wall of said building but able to be extended to project from said exterior vertical wall of said building;

a generally rectangular recess in each of said retractable floors;

an extendible stair unit mounted within each of said recesses; each stair unit including a perimeter frame fit within said recess and a set of stair sections stored in a stack one atop the other and lying horizontally within said frame;

latch means for releasably holding each of said stair unit sections in its respective frame;

means interconnecting and mounting said stair sections so as to allow the top most section in said stack to move downwardly and to an end to end relationship with the next below stair section in said stack upon release of said latch means, the next below stair section connected to said frame to become the upper stair section in an extended set of stair sections;

control means for selectively releasing all of said latch means after extending of said retractable floors when an emergency situation exists.

* * * * *